US005139731A

United States Patent [19]

Hendry

[11] Patent Number: 5,139,731

[45] Date of Patent: Aug. 18, 1992

[54] SYSTEM AND METHOD FOR INCREASING THE EFFICIENCY OF A CYCLOTRON

[75] Inventor: George O. Hendry, Napa County, Calif.

[73] Assignee: CTI, Incorporated, Knoxville, Tenn.

[21] Appl. No.: 699,006

[22] Filed: May 13, 1991

[51] Int. Cl.[5] ..... H05H 13/00

[52] U.S. Cl. ..... 376/112; 313/62; 328/234

[58] Field of Search ..... 376/112, 129, 107, 127; 313/62; 328/234; 250/493.1, 423 R; 315/111.81, 111.91

[56] References Cited

U.S. PATENT DOCUMENTS 4,771,208 9/1988 Jongen et al. ..... 313/62
5,017,882 5/1991 Finlan ..... 328/234

FOREIGN PATENT DOCUMENTS

86/06924 11/1986 World Int. Prop. O. .

OTHER PUBLICATIONS

Blasser, H. G., "The Michigan State University Superconducting Cyclotron Program", IEEE NS-26, Apr. 1979, pp. 2040 and 2042.
Excerpt from Japan Steel Works (JSW) sales brochure dated 1984.
Hartwig, E.; "The AEG Compact Cyclotron"; Published in proceedings held Sep. 17-20, 1969.
Jongen, Y. et al. "Preliminary Design for a K=30, 500 μA H-Cyclotron", Oct., 1985.
Clark, D. et al. "Design and Operation of the UCLA 50 MeV Spiral-Ridge Cyclotron", 1962.
Martin, J. A., "Cyclotrons-1978", Apr., 1979.

*Primary Examiner*—Daniel D. Wasil
*Attorney, Agent, or Firm*—Pitts and Brittian

[57] ABSTRACT

In a negative hydrogen ($H^-$) ion cyclotron, a system and method for improving the efficiency of the cyclotron by minimizing loss, i.e., neutralization, of $H^-$ ions within the acceleration region of the cyclotron caused by gas stripping. The system includes a cyclotron volume, an ion source within the ion source volume is maintained at a negative potential and located proximate the cyclotron center on the plane of acceleration. The vacuum system includes a main vacuum pump for evacuating the cyclotron volume and an ion source pump for separately evacuating the ion source volume to remove hydrogen ($H_2$) gas molecules which could cause gas stripping if injected into the cyclotron volume. In the preferred embodiment, the system further has a pumping volume, communicating between the ion source volume and the cyclotron volume, and a separate pumping volume vacuum passageway whereby the ion source volume is evacuted in two stages. An ion beam passageway from the ion source volume to the pumping volume and one from the pumping volume to the cyclotron volume have gas conductances substantially less than gas conductances of connections between the vacuum pumps and the various volumes whereby enhanced differential pumping of undesired species is accomplished to minimize ion loss. Furthermore, the radio-frequency system is operated at a frequency four times that of the ion beam orbital frequency.

9 Claims, 2 Drawing Sheets

SYSTEM AND METHOD FOR INCREASING THE EFFICIENCY OF A CYCLOTRON

DESCRIPTION

1. Technical Field

This invention relates to an improved system and method for increasing the efficiency of a cyclotron and more particularly a negative hydrogen ($H^-$) ion cyclotron.

2. Background Art

Cyclotrons have been known for many years. Since the beginning of the atomic age, many uses have been developed for particle accelerators, of which a cyclotron is one type. Particle accelerators are used to accelerate subatomic particles or ions, and more particularly to produce a beam of accelerated subatomic particles. The beam of accelerated (i.e., high energy) particles can be used to bombard a variety of target materials to produce radioactive isotopes having a variety of uses. For example, various isotopes produced in this manner have been used in medicine as tracers which are injected into the body, and in radiation treatments for cancer.

A cyclotron is a type of particle accelerator in which charged particles are accelerated through a substantially spiral path which increases in radius through the range of acceleration. The particles are accelerated using the forces of electrical potential and magnetic fields. The particles are accelerated as they pass through a gap between two electrodes, the first electrode having the same (sign) charge as the particle, e.g., negative (−), and the second electrode having the opposite (sign) charge as the particle, e.g., positive (+); the first electrode tending to push or repel the particle across the gap and the second electrode tending to pull or attract the particle across the gap. The path of the accelerated particle is then bent by a magnetic field into a spiral path which tends to cause the particle to be directed back across the gap. By alternately changing the polarity of the electrodes by means of a radio-frequency generating system, the particles are accelerated with each crossing of the gap, thereby increasing the radius of the spiral path of the accelerated particles. Most prior art cyclotrons use positively charged particles. The cyclotron of the present invention is a negative ion cyclotron.

The charged particles are accelerated within a substantially planar volume (hereinafter referred to as the "acceleration region") within the cyclotron. This volume must be highly evacuated to remove undesirable gaseous particles which could interact with the accelerated particles, resulting in a reaction which would cause the accelerated particle to be "lost". For example, in a cyclotron used to accelerate negative hydrogen ($H^-$) ions, a hydrogen gas ($H_2$) molecule in the acceleration region of the cyclotron can strip off the weakly-bound second electron of the $H^-$ ion. When the ion loses this electron, it becomes a neutral particle which is no longer affected by the acceleration gaps or magnetic field within the cyclotron. As a result, the accelerated neutral particle "flies off" in a tangential direction and never reaches the end of the spiral acceleration path where the beam of accelerated particles is extracted from the cyclotron. In addition to being lost from the beam of accelerated particles, the accelerated neutral particle can cause an undesirable reaction in the material in which it is subsequently absorbed because of its high energy.

In light of the above, it can be seen that the quality of the vacuum achieved within the cyclotron plays a key role in the efficiency of the cyclotron. Residual gas molecules present in the acceleration region of the cyclotron act as stripping centers that can remove negative ions from the accelerating beam as described above. Previous $H^-$ cyclotrons have suffered ions from relatively low efficiency because residual $H_2$ gas molecules from the $H^-$ ion source, injected into the cyclotron along with the ions to be accelerated, stripped some of the ions before being removed by the cyclotron vacuum system.

In addition to the stripping caused by residual $H_2$ gas molecules, ions can be stripped by water vapor molecules which are produced by "outgassing" of the cyclotrons inner surfaces.

In some $H^-$ cyclotrons, the ion source is placed outside of the cyclotron acceleration chamber where it can be separately pumped to prevent residual $H_2$ gas from reaching the acceleration region of the cyclotron volume. With this approach, it is necessary to inject the ion beam into the cyclotron along its magnetic axis. The beam then must be bent into the mid-plane of the cyclotron where it is subsequently accelerated. This method involves additional cost and complexity.

Therefore, it is a primary object of the present invention to provide a system and method for minimizing loss of efficiency in a negative hydrogen ion cyclotron caused by gas stripping of the ions within the accelerated region of the cyclotron.

It is a further object of the present invention to provide a system and method for minimizing neutral particle radiation in a negative hydrogen ion cyclotron caused by gas stripping of accelerated ions within the accelerated region of the cyclotron.

It is still another object of the present invention to provide a system and method whereby a smaller, lower weight negative hydrogen ion cyclotron can be provided at a relatively low cost.

It is another object of the present invention to provide such a cyclotron with a negatively biased, axially-inserted hydrogen negative ion source located near the cyclotron center and substantially on the plane of acceleration.

It is still another object of the present invention to provide such a cyclotron with a radio-frequency system operating at four times the orbiting frequency of the ion beam.

It is a further object of the present invention to provide such a cyclotron with a substantially higher acceleration efficiency than conventional $H^-$ cyclotrons.

DISCLOSURE OF THE INVENTION

Other objects and advantages will be accomplished by the present invention which provides a system and method for minimizing loss of efficiency in a negative hydrogen ion cyclotron caused by gas stripping of the negative hydrogen ions within the acceleration region. The system comprises a negative hydrogen ion cyclotron which defines a cyclotron volume, a negative hydrogen ion ($H^-$) source which defines a $H^-$ ion source volume, and a vacuum system. The vacuum system includes a main pump for pumping, i.e., evacuating the cyclotron volume, and an ion source pump for separately evacuating the $H^-$ ion source volume. A passageway is provided between and communicating with the ion source volume and the ion source pump, this passageway having a relatively high gas conductance to facilitate the evacuation of $H_2$ gas from the ion source volume by the ion source pump. Another passageway is provided between and communicating with the cyclotron volume and the main pump which facilitates the evacuation of the cyclotron volume, the gas conductance of the passageway and the capacity of the main pump being selected such that the equilibrium pressure in the cyclotron volume is many times less than that in the ion source volume. In the preferred embodiment, it has been calculated that the equilibrium pressure in the ion source volume will be thirty thousand ($3\times10^4$) times greater than that in the cyclotron volume. Yet another passageway is provided between and communicating with the ion source volume and the cyclotron volume, the gas conductance of which is sufficiently low that the flow of $H_2$ gas from the ion source volume into the cyclotron volume is minimal, while still permitting a $H^-$ ion beam to pass through it from the ion source volume to the cyclotron volume.

Accordingly, a system and method of increasing the efficiency of the cyclotron and reducing neutral particle radiation is provided by minimizing the residual $H_2$ gas passing from the ion source volume into the cyclotron volume, where such gas could strip the negative hydrogen ions in the acceleration region.

In the preferred embodiment, the system further includes a pumping volume in communication with the ion source volume and the cyclotron volume. Passageways are provided in communication between the ion source volume and the pumping volume, and between the pumping volume and the cyclotron volume, respectively, such passageways having a sufficiently low gas conductance that the flow of residual $H_2$ gas through them is minimal, while still permitting an ion beam to pass through them and into the cyclotron. Yet another passageway is provided for separately communicating between the pumping volume and the ion source pump, such passageway having a sufficiently large gas conductance to permit evacuation of residual $H_2$ gas from the pumping volume. Accordingly, a system and method is provided in the preferred embodiment whereby residual $H_2$ gas is removed from the pumping volume. Accordingly, a system and method is provided in the preferred embodiment whereby residual $H_2$ gas from the ion source volume is evacuated in two stages before it can enter the cyclotron volume, thereby increasing the efficiency of the system. And, further, in order to reduce the size of the cyclotron magnet and radio-frequency system, the radio-frequency system is operated at a frequency four times that of the ion beam orbit frequency, in a preferred embodiment. It will be recognized, however, that other integral multiples of the ion beam orbit could be chosen as well.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
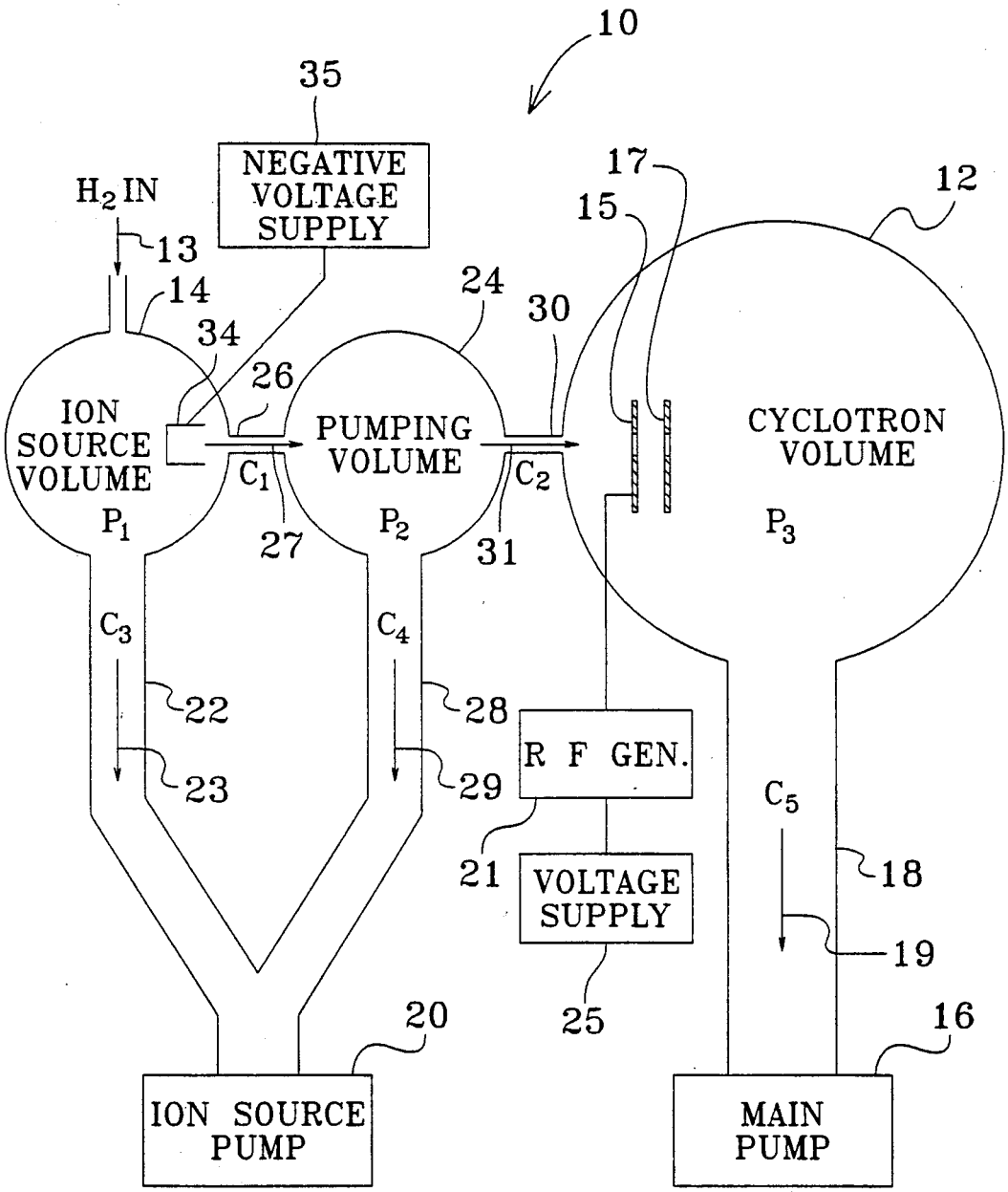
FIG. 1 illustrates a cyclotron vacuum pumping schematic according to a preferred embodiment of the present invention.

A system and method for minimizing loss of efficiency in a negative hydrogen ion ($H^-$) cyclotron caused by gas stripping of the $H^-$ ions in the acceleration region of the cyclotron is diagrammatically illustrated at 10 in FIG. 1. The system 10 includes a negative hydrogen ion cyclotron having a cyclotron volume 12 which further defines an acceleration region (not shown) of the cyclotron, and an ion source volume 14. Though not a part of the present invention, it will be appreciated by those skilled in the art that means for producing an $H^-$ ion beam from supplied $H_2$ gas, indicated by the arrow 13 in FIG. 1, within the ion source volume 14 will be provided. It is a feature of the present invention that the aforementioned means for producing an $H^-$ ion beam from supplied $H_2$ gas will be located proximate the cyclotron center and on the plane of acceleration in order to start the said $H^-$ beam on the plane of acceleration. This ion source is provided with a negative bias to aid in extracting the negative ions from the source and providing them with the necessary velocity and radius of curvature to move through the ion passageway.

Still referring to FIG. 1, a main vacuum pump 16 is provided which evacuates the cyclotron volume 12 via the main vacuum passageway 18. The gas conductance in passageway 18 is indicated as $C_5$. An ion source pump 20 evacuates the ion source volume 14 via the source volume vacuum passageway 22 which has a sufficiently large gas conductance ($C_3$) to permit evacuation of residual hydrogen gas from the ion source volume 14. As will be discussed with regard to FIG. 2, the ion source volume 14 surrounding the ion source is positioned near the center of the cyclotron. The ion beam produced in the ion source is directed from the ion source volume to the pumping volume 24 via the first ion passageway 26 which has a much smaller gas conductance ($C_1$) the source volume vacuum passageway 22, thereby minimizing the amount of residual $H_2$ gas which passes through it. However, a small but significant amount of residual $H_2$ gas does pass from the ion source volume 14 into the pumping volume 24 through the passageway 26 along with the ion beam. The pumping volume 24 is evacuated by the ion source pump 20 via the pumping volume vacuum passageway 28 which has a relatively large gas conductance ($C_4$) to facilitate the evacuation of this residual $H_2$ gas in the pumping volume 24. A second ion passageway 30 is provided through which the ion beam is directed from the pumping volume 24 into the cyclotron volume 12 proximate the center of the acceleration region of the cyclotron. The gas conductance ($C_2$) of the second ion passageway 30 is low enough that the amount of residual $H_2$ gas passing from the pumping volume into the cyclotron volume is minimal. The path of the ion beam and residual $H_2$ gas through the passageways 26 and 30 is indicated by the arrows 27 and 31, respectively, in FIG. 1. It will also be noted that the flow of gases evacuated from the ion source volume 14, pumping volume 24, and the cyclotron volume 12, is indicated by the arrows 23, 29 and 19, respectively. In light of the foregoing, it will be appreciated that a system 10 is provided whereby residual $H_2$ gas passing into the cyclotron volume 12 from the ion source volume is minimized, thereby increasing efficiency of a negative hydrogen ion ($H^-$) cyclotron by reducing gas stripping of ions in the acceleration region of the cyclotron. It will be appreciated by those skilled in the art that a $H^-$ cyclotron utilizing the features of the above-described invention can be constructed in number of ways.

Illustrated in schematic form in FIG. 1 are some of the substantially conventional portions of the present cyclotron. For example, the radio-frequency generating system is made up of an RF generator 21 that is fed by a voltage supply 25. This causes the alternation of the potential applied to the electrodes 15, 17 that provide acceleration to ions within the cyclotron volume 12. Also shown in this figure is an ion source 34 within the ion source volume 14, with this ion source being connected to a negative voltage supply 35 such that the ion source 34 is negatively biased.

Figure 2:
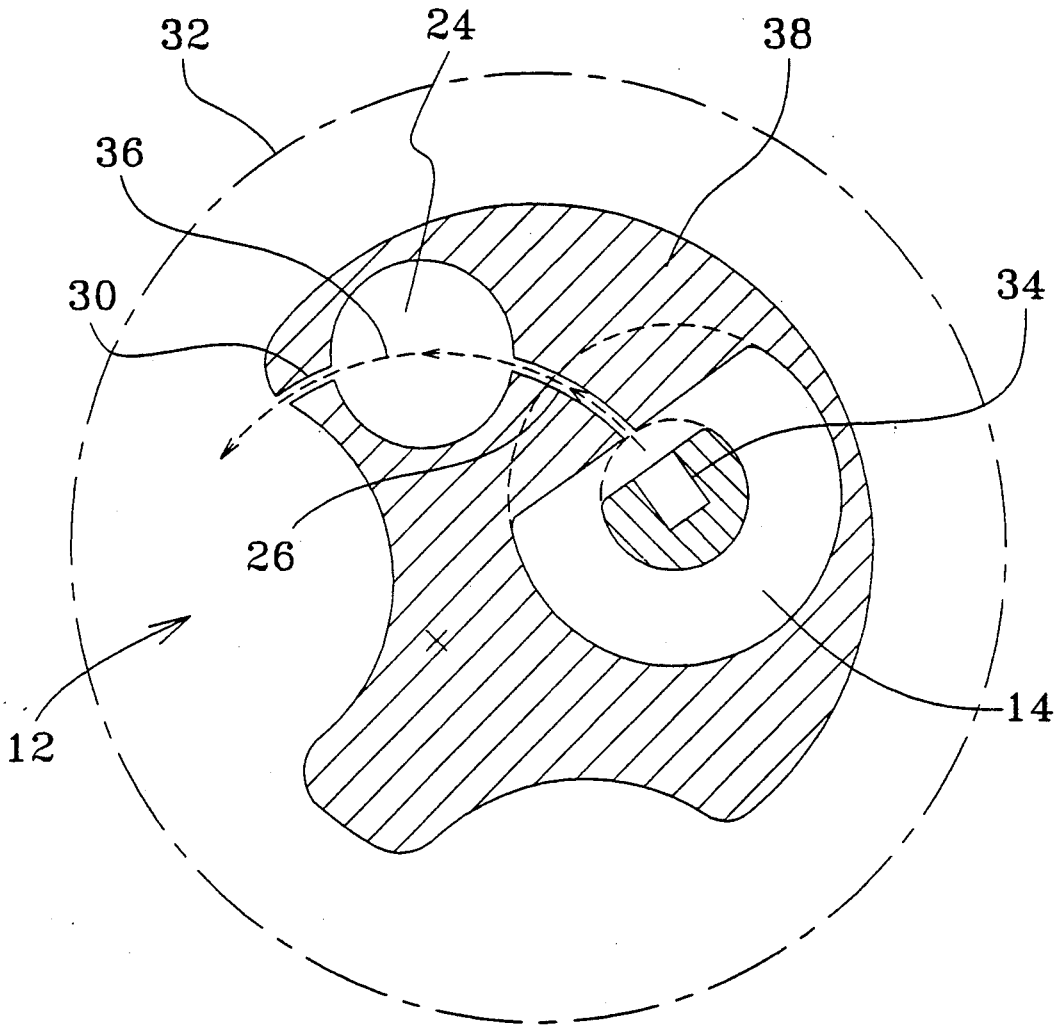
FIG. 2 is a cross-sectional drawing of a central region of the cyclotron of the present invention depicting the position of the components of the pumping schematic of FIG. 1.

Referring to FIG. 2, a cross-sectional mid-plane view of a small section, defined by the diagrammatic circle 32, of the central region, i.e., acceleration region, of a cyclotron employing this preferred embodiment of the present invention is shown. From this figure, it can be seen that the ion beam produced by an ion source 34 passes along path 36 from the ion source volume 14 into the pumping volume 24 through the ion passageway 26, and from the pumping volume 24 into the cyclotron volume 12 through the ion passageway 30, all in the mid-plane of the cyclotron where it is accelerated. Because the ion beam enters the acceleration region in the same plane as that in which it is accelerated, means for bending the beam into that plane are not required as in the case of an externally positioned ion source.

The magnetic field of a cyclotron is typically created by electromagnetic coils together with magnet pole pieces. In the cyclotron of the present invention, any of the known types of electromagnetic coils can be used. Although the coils are not shown in FIG. 2, the position of the coils will be known to persons skilled in the art. The type of coil winding includes, for example, coil windings fabricated from superconducting materials.

It will be noted that the ion passageways 26 and 30, respectively, follow a curved path in the mid-plane of the cyclotron. This is necessary because the $H^-$ ions have velocity provided by a negative potential on the ion source. This velocity and the negative charge interact with the magnetic field of the cyclotron, thereby bending the ion beam through this path as it travels into the cyclotron volume.

The accelerating field of the cyclotron is created by a radio-frequency system, as is well-known to those skilled in the art. However, in order to reduce the size of the cyclotron magnet and radio-frequency system, the radio-frequency system of the cyclotron of the present invention will be operated at a frequency four times greater than the ion beam orbital frequency. This is a departure from the practice of conventional cyclotrons, and forms one of the features of the present invention. Operation at this higher frequency is made possible by the application of a negative bias to the ion source. Otherwise, if this very rapidly varying potential were used to both extract ions from the source and to accelerate the ions across the first acceleration gap (as in conventional cyclotrons), a much lower ion beam intensity would be realized. This is due to the fact that the RF potential can reverse itself before the ion completely crosses the acceleration gap. Only those ions which are extracted from the source early in the RF cycle successfully cross the gap. The intensity of a beam of ions extracted early in the RF cycle would be low since the electric field across the gap would be low at this time. The negatively biased ion source of the present invention avoids this problem.

It has been determined that an $H^-$ cyclotron constructed in accordance with the above-described preferred embodiment can be designed to achieve a ninety-seven percent (97%) efficiency, i.e., only three percent (3%) of the ions injected into the center of the acceleration region of the cyclotron are lost to gas stripping before being extracted. This conclusion follows from the knowledge that, in previous cyclotrons, the fraction of $H^-$ ions that do not undergo gas stripping within a radius R from the center of the cyclotron (i.e., those that survive) has been found to obey the empirical relation:

$$f(R)=\exp(-8.4\times10^3\,PR/V_0)$$

where P is the residual gas pressure in units of $10^{-6}$ torr, R is the radius (measured from the center of the cyclotron) in meters, and $V_0$ is the energy gain per turn in MeV. This expression has been found to be generally applicable to any $H^-$ cyclotron, when hydrogen ($H_2$) is the only residual gas present. Other gases contribute to stripping in direct proportion to the number of electrons in the gas molecule. For example, water ($H_2O$), with ten electrons, is five times as effective at stripping as $H_2$, which has only two electrons per molecule. If any gases other than $H_2$ are present, their pressure contribution must be converted to an effective $H_2$ pressure by multiplying the partial pressure by the appropriate ratio.

In a cyclotron design under consideration, the principal residual gas constituents and their sources are $H_2$, from the ion source, and $H_2O$, from outgassing of the cyclotron inner surfaces. By constructing the cyclotron in accordance with the present invention, an effective $H_2$ residual pressure of $1\times10^{-6}$ torr can be achieved by limiting the true $H_2$ pressure to $5\times10^{-7}$ torr, and the $H_2O$ pressure to $1\times10^{-7}$ torr. In a cyclotron having a beam radius at extraction of 0.7 m, and an energy gain per turn of 0.2 MeV, the overall extraction efficiency obtained will be:

$$f=\exp[-8.4\times10^{-3}(1.0)(0.7)/(0.2)]=0.97$$

Thus, as indicated above, only three percent (3%) of the injected ions will be lost to gas stripping before being extracted.

Referring back to FIG. 1, the indicated efficiency is obtained by constructing the cyclotron in accordance with the present invention in which: $C_1$ is the gas conductance of the first ion passageway 26; $C_2$ is the gas conductance of the second ion passageway 30; $C_3$ is the conductance of the ion source volume passageway 22; $C_4$ is the gas conductance of the pumping volume vacuum passageway 28; $C_5$ is the gas conductance of the main vacuum passageway 18; $P_1$ is the equilibrium pressure in the ion source volume 14; $P_2$ is the equilibrium pressure in the pumping volume 24; and $P_3$ is the equilibrium pressure in the cyclotron volume 12. The indicated passageways are dimensioned to have the gas conductances, shown in Table I, shown below. Given the gas conductances, the pressures $P_1$–$P_3$ can be calculated. Table I below, lists the approximate gas conductance values for both 12 MeV and 30 MeV cyclotron designs, along with the resulting pressures, assuming that the $H_2$ input flow rates (shown at 13 in FIG. 1) are as indicated (1 sccm=0.012 torr l $s^{-1}$).

TABLE I (Approximate $H_2$ gas conductances and equilibrium pressures)

| | 12 MeV | 30 MeV |
|---|---|---|
| $H_2$ flow (sccm) | 5 | 10 |
| $C_1$ ($l\ s^{-1}$) | 0.3 | 0.3 |
| $C_2$ | 0.7 | 0.7 |
| $C_3$ | 10 | 10 |
| $C_4$ | 5 | 5 |
| $C_5$ | 400 | 2000 |
| $P_1$ (torr) | $3 \times 10^{-3}$ | $6 \times 10^{-3}$ |
| $P_2$ | $1 \times 10^{-4}$ | $3 \times 10^{-4}$ |
| $P_3$ | $3 \times 10^{-7}$ | $1 \times 10^{-7}$ |
| Ion Source Pump speed ($l\ s^{-1}$) | 230 | 230 |
| Main Pump speed ($l\ s^{-1}$) | 4500 | 18000* |

*IT IS CONTEMPLATED THAT THE EFFECTIVE PUMP SPEED FOR THE 30 MeV SYSTEM CAN BE OBTAINED BY USING FOUR PUMPS COMPARABLE TO THAT USED IN THE 12 MeV SYSTEM.

Thus, the $H_2$ pressure in the cyclotron volume 12 is well below the goal of $5 \times 10^{-7}$ torr required to achieve an efficiency of 97%. The applicant is aware of technology (not the subject of this invention) which will permit the achievement of the goal of providing a cyclotron in which an $H_2O$ base pressure of less than $1 \times 10^{-7}$ torr is obtained.

Therefore, a system and method is provided by the present invention whereby the efficiency of a negative hydrogen ion cyclotron is increased by minimizing gas stripping of ions in the acceleration region of the cyclotron. Further, by minimizing gas stripping of ions, undesirable neutral particle radiation is significantly reduced. Because of the improved efficiency, a smaller, lower weight negative hydrogen ion cyclotron is provided which can be built at a lower cost than previous cyclotrons having a comparable output. Further savings in weight, size, and cost will be realized through the operating of the radio-frequency system of the cyclotron of the present invention at a frequency four times greater than the ion beam orbital frequency.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A negative hydrogen ion cylcotron system having improved efficiency by reducing collisions of hydrogen ions with residual neutral atoms and molecules within said cyclotron, which comprises:

a cyclotron having a cyclotron volume, a magnetic system for producing a magnetic field for the deflection of ions within said cyclotron volume, and a radio-frequency system for accelerating said ions within said cyclotron volume, said cyclotron volume having an acceleration plane in which said hydrogen ions are accelerated and deflected in a spiral path at an ion orbital frequency;

pumping means connected to said cyclotron volume by a first vacuum pumping passageway having a selected gas conductance for producing a selected vacuum within said cyclotron volume to minimize collisions between hydrogen ions and residual molecules within said cyclotron volume;

an ion source volume disposed within said cyclotron on said acceleration plane proximate a center of said spiral path;

an ion source biased by a negative voltage supply disposed within said ion source volume for producing negative hydrogen ions for acceleration within said cyclotron volume by said radio-frequency system;

further pumping means connected to said ion source volume through a further vacuum pumping passageway having a selected gas conductance; and an ion beam passageway communicating between said ion source volume and said cyclotron volume for conveying ions into said cyclotron volume for acceleration by said radio-frequency system, said ion beam passageway having a selected gas conductance less than said gas conductance of said first and further vacuum pumping passageways whereby said further pumping means preferentially removes said neutral atoms and molecules from said ion source volume, said ion beam passageway configured to pass said ions along an arc determined by said negative voltage source and said magnetic field.

2. The system of claim 1 further comprising a pumping volume disposed within said cyclotron intermediate, and in communication with, said ion source volume and said cyclotron volume, wherein said ion beam passageway has a first portion communicating between said ion source volume and said pumping volume and a second portion communication between said pumping source volume and said cyclotron volume, and wherein said further pumping means is connected to said pumping volume through a third vacuum pumping passageway having a selected gas conductance substantially equal to said further vacuum pumping passageway.

3. The system of claim 1 wherein said gas conductance of said ion beam passageway is about $2 \times 10^{-2}$ to about $15 \times 10^{-2}$ times said gas conductance of said vacuum pumping passageways.

4. The system of claim 1 wherein said radio-frequency system is operated at a frequency four times that of said ion orbital frequency.

5. A negative hydrogen ion cylcotron system having improved efficiency by reducing collisions of hydrogen ions with residual neutral atoms and molecules within said cyclotron, which comprises:

a cyclotron having a cyclotron volume, a magnetic system for producing a magnetic field for the deflection of ions within said cyclotron volume, and a radio-frequency system for accelerating said ions within said cyclotron volume, said cyclotron volume having an acceleration plane in which said hydrogen ions are accelerated and deflected in a spiral path at an ion orbital frequency;

pumping means connected to said cyclotron volume by a first vacuum pumping passageway having a selected gas conductance for producing a selected vacuum within said cyclotron volume to minimize collisions between said hydrogen ions and residual molecules within said cyclotron volume;

an ion source volume disposed within said cyclotron on said acceleration plane proximate a center of said spiral path;

a negatively biased ion source disposed within said ion source volume for producing negative hydrogen ions for acceleration within said cyclotron volume by said radio-frequency system;

a pumping volume disposed within said cyclotron on said acceleration plane proximate said center of said spiral path;

further pumping means connected through second and third vacuum pumping passsageways to said ion source volume and said pumping volume, respectively, said second and third vacuum pumping passageways each having a selected gas conductance;

a first ion beam passageway communicating between said ion source volume and said pumping volume for conveying ions from said ion source into said pumping volume, said first ion beam passageway having a selected gas conductance substantially less than said gas conductance of said second and third vacuum pumping passageways whereby said further pumping means preferentially removes said neutral atoms and molecules from said ion source volume;

a second ion beam passageway communicating between said pumping volume and said cyclotron volume for conveying ions from said pumping volume into said cyclotron volume for acceleration by said radio-frequency system, said second ion beam passageway having a selected gas conductance substantially less than said gas conductance of said second and third vacuum pumping passageways whereby said further pumping means preferentially removes said neutral atoms and molecules from said pumping volume;

a negative voltage source attached to said ion source for accelerating said negative hydrogen ions such that they pass through said first and second ion beam passageways; and wherein said first and second ion beam passageways have a gas conductance about $2\times10^{-2}$ to about $15\times10^{-2}$ times said gas conductance of said first, second and third vacuum pumping passageways and configured to pass said ions along an arc determined by said negative voltage source and said magnetic field.

6. The system of claim 5 wherein said radio-frequency system is operated at a frequency four times that of said ion orbital frequency.

7. A method for increasing the efficiency of a negative hydrogen ion cyclotron by reducing collisions between negative hydrogen ions and residual neutral atoms and molecules within said cyclotron, said cyclotron having an internal cyclotron volume and a magnetic system for deflecting, and a radio-frequency system for accelerating, said negative ions in an acceleration plane within said cyclotron volume in a spiral path at an orbital frequency, said method comprising the steps:

evacuating said cyclotron volume with a first pumping means connected to said cyclotron volume with a first pumping passageway having a selected gas conductance to a selected pressure to minimize said collisions of ions with neutral atoms and molecules within said cyclotron volume;

producing said negative hydrogen ions with an ion source within an ion source volume located proximate a center of said cyclotron and on said acceleration plane;

passing said negative hydrogen ions through a first ion beam passageway from said ion source volume into a pumping volume located proximate said center of said cyclotron and on said acceleration plane, said first ion beam passageway having a selected gas conductance;

passing said negative ions through a second ion beam passageway from said pumping volume into said cyclotron volume for acceleration by said radio-frequency system, said second ion beam passageway having a selected gas conductance;

evacuating said ion source volume to a selected pressure with a second pumping means connected to said ion source volume by a second pumping passageway having a selected gas conductance greater than said gas conductance of said first ion beam passageway;

evacuating said pumping volume to a selected pressure with said second pumping means connected to said pumping volume by a third pumping passageway having a selected gas conductance greater than said gas conductance of said second ion beam passageway; and whereby said greater gas conductances of said second and third pumping passageways provided for preferential pumping or said neutral atoms and molecules from said ion source volumes and said pumping volume thereby reducing collisions between said ions from said ion source and said neutral atoms and molecules and thereby increasing efficiency of said cyclotron.

8. The method of claim 7 wherein said gas conductance of said first, second and third pumping passageways is from about $2\times10^{2}$ to about $15\times10^{2}$ the gas conductance of said first and second ion beam passageways.

9. The method of claim 7 wherein said radio-frequency system is operated at four times said orbital frequency of said ions in said cyclotron.

* * * * *